United States Patent [19]

Fitzpatrick

[11] 3,984,092

[45] Oct. 5, 1976

[54] ARTICLE GRIPPING ADAPTER FOR CLAMPS

[76] Inventor: John L. Fitzpatrick, 929 SW. 66, Oklahoma City, Okla. 73139

[22] Filed: June 4, 1975

[21] Appl. No.: 583,736

[52] U.S. Cl. ..... 269/88; 81/422; 269/96; 269/100; 269/258

[51] Int. Cl.[2] ..... B25B 1/14

[58] Field of Search..... 269/258, 100, 88, 91–94, 269/96; 81/424, 425, 426, 418, 420, 421, 422, 423, 367–384

[56] References Cited

UNITED STATES PATENTS

| | | | |
|---|---|---|---|
| 2,731,932 | 1/1956 | Petersen | 81/372 |
| 2,990,213 | 6/1961 | Kolacinski | 81/424 |
| 3,124,347 | 3/1964 | Haddad | 269/91 |
| 3,446,102 | 5/1969 | Hallmark | 81/422 |
| 3,575,405 | 4/1971 | Harding | 269/258 |

*Primary Examiner*—Al Lawrence Smith
*Assistant Examiner*—Robert C. Watson
*Attorney, Agent, or Firm*—Robert K. Rhea

[57] ABSTRACT

A substantially table-like member transversely defining a T-shape is pivotally connected by its leg portions to the end portion of one jaw of a clamp. An article engaging surface of the adapter is provided with one or more recesses for engaging irregular surfaces to be gripped by the clamp. The T-shape of the adapter secures one jaw of the clamp to a workpiece engaging tool by inverting the adapter and slidably inserting it into a T-shaped slot.

1 Claim, 5 Drawing Figures

FIG.4

ARTICLE GRIPPING ADAPTER FOR CLAMPS

BACKGROUND OF THE INVENTION

1. Field of the Invention

The present invention relates to clamps and more particularly to an adapter forming a pressure foot for connection with one jaw of a clamp for engaging and holding a workpiece in cooperation with the other jaw of the clamp.

2. Description of the Prior Art

The prior art generally discloses adapters of a specialized nature for connection with the jaws of clamps, such as for conforming to the periphery of tubular members or bolts and for gripping opposing surfaces of sheet metal troughs having irregular and curved surfaces. Adapters for clamps, as disclosed by the prior art, thus are limited to the article they were designed to engage whereas this invention provides an adapter for one member of a pair of clamp members which serves to hold a number of different shaped members and holds a workpiece under any one of a series of different conditions.

SUMMARY OF THE INVENTION

The adapter is substantially table-like and T-shaped in transverse section and is pivotally connected to the end portion of a clamp jaw by the stem or leg of its T-shape. The top of the T-shape forms a workpiece engaging surface in cooperation with a clamp jaw and the workpiece engaging surface is preferably provided with at least one arcuate recess for conforming to any irregular surface of a workpiece or tool to be gripped by a clamp and the adapter. The T-shape of the adapter permits it to be slidably received within a T-shaped slot of a workpiece processing equipment.

The principal object of this invention is to provide a clamp jaw pressure foot or adapter for connection with a workpiece engaging portion of a clamp for gripping a workpiece in cooperation with an opposite workpiece engaging portion of the clamp.

BRIEF DESCRIPTION OF THE DRAWINGS

FIG. 1 is an elevational view, partially in section, illustrating the adapter secured to a pliers-type clamp and impinging a workpiece on a drill press platform, or the like;

DESCRIPTION OF THE PREFERRED EMBODIMENT

Figure 1:
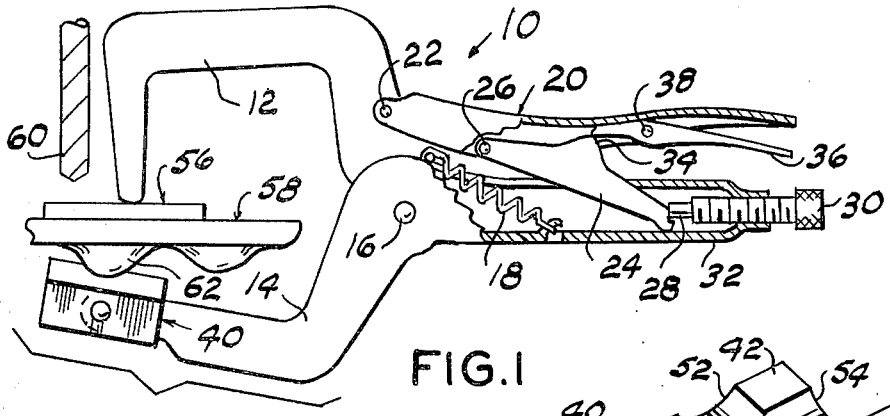
Figure 2:
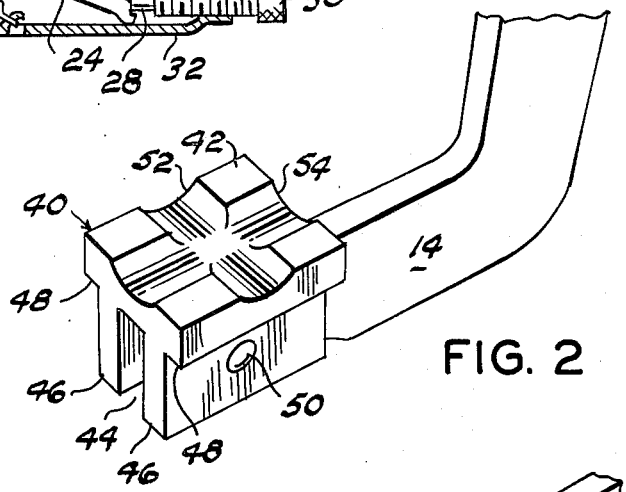
FIG. 2 is a fragmentary perspective view, to an enlarged scale, of the adapter secured to a fragment of a clamp jaw.

Like characters of reference designate like parts in those figures of the drawings in which they occur.

In the drawings:

The reference numeral 10 indicates a clamp device of the pliers-type having opposed jaws 12 and 14 pivotally hinged together, as at 16. A spring 18 tends to hold the jaws in a separated position while a toggle mechanism is provided to urge the jaws toward each other or a workpiece disposed therebetween, as presently explained.

The toggle mechanism includes an operating lever 20 hinged to the U-shaped jaw 12, as at 22, and a toggle arm 24 hinged, at one end, to the lever, as at 26. The other end of the toggle arm 24 engages an abutment 28 formed on the end of an adjusting screw 30 threadedly supported by the handle portion 32 of the L-shaped jaw 14. The toggle arm 24 is provided with a lateral extension 34 projecting toward the operating lever 20 and underlying an end portion of a release lever 36 pivotally secured to the operating lever, as at 38. When the operating lever 20 is moved toward the handle portion 32, the jaws 12 and 14 are forced toward each other and a workpiece therebetween so that the toggle arm pivot point 26 is off-set toward the jaw pivot point 16 with respect to a line extending between the bolt projection 28 and operating lever hinge point 22 thus locking the clamp in a closed position. The clamp jaws are released by simply moving the free end portion of the operating lever toward the adjacent operating lever end portion which breaks the toggle.

The clamp thus far described is the same as that shown and described in Pettersen U.S. Pat. No. 2,641,149 and its details form no part of the invention other than to set forth the combination of one locking-type clamp with which the invention may be used. Obviously, other clamping vises featuring jaws movable toward and away from each other or a C-type clamp may be used in place of the pliers-type clamp illustrated provided the jaws thereof are of a flat form and are disposed in a common plane.

The reference numeral 40 indicates the adapter, as a whole, which is somewhat rectangular in general appearance but is characterized by a modified T-shape in transverse section. The adapter includes a substantially rectangular block portion 42 forming the top of the T-shape and ledges 48 overhanging a thickened stem portion which is bifurcated, as at 44, to form a pair of parallel panel-like leg portions 46 extending longitudinally of the rectangular-shape with the plane of each leg normal to the plane of the block 42 or top of the T-shape. The purpose of the bifurcation or slot 44 is for straddling the workpiece engaging end portion of one of the clamp jaws for example the jaw 14. The adapter legs 46 are pivotally secured to the jaw 14 by a pin 50 extending transversely therethrough. The surface of the T-shaped top 42, opposite the legs 46, is preferably arcuately recessed transversely and longitudinally in 90° relation, as at 52 and 54, for selectively engaging irregular and circular shaped workpieces as presently explained.

OPERATION

In operation, FIG. 1 illustrates the adapter and clamp device 10 in a first position impinging a workpiece 56 against the upper surface of a drill press platform or table 58, or the like, with work to be performed as by the drill press bit 60. The drill press table 58 is normally provided with arcuate or irregular reinforcing surfaces or ribs 62 on its depending surface which are readily engaged in cooperative relation by one of the recesses 52 or 54 of the adapter for cooperating with the clamp jaw 12 in gripping the workpiece 56.

Figure 5:
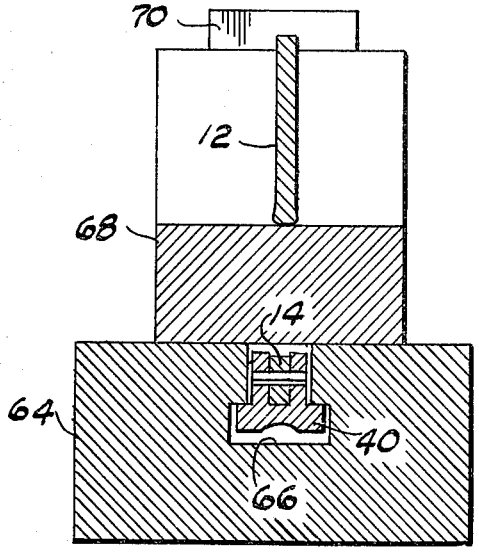
Figure 3:
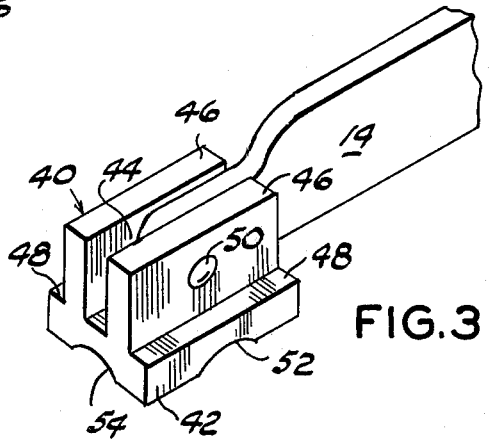
FIG. 3 is an inverted perspective view of FIG. 2.
Figure 4:
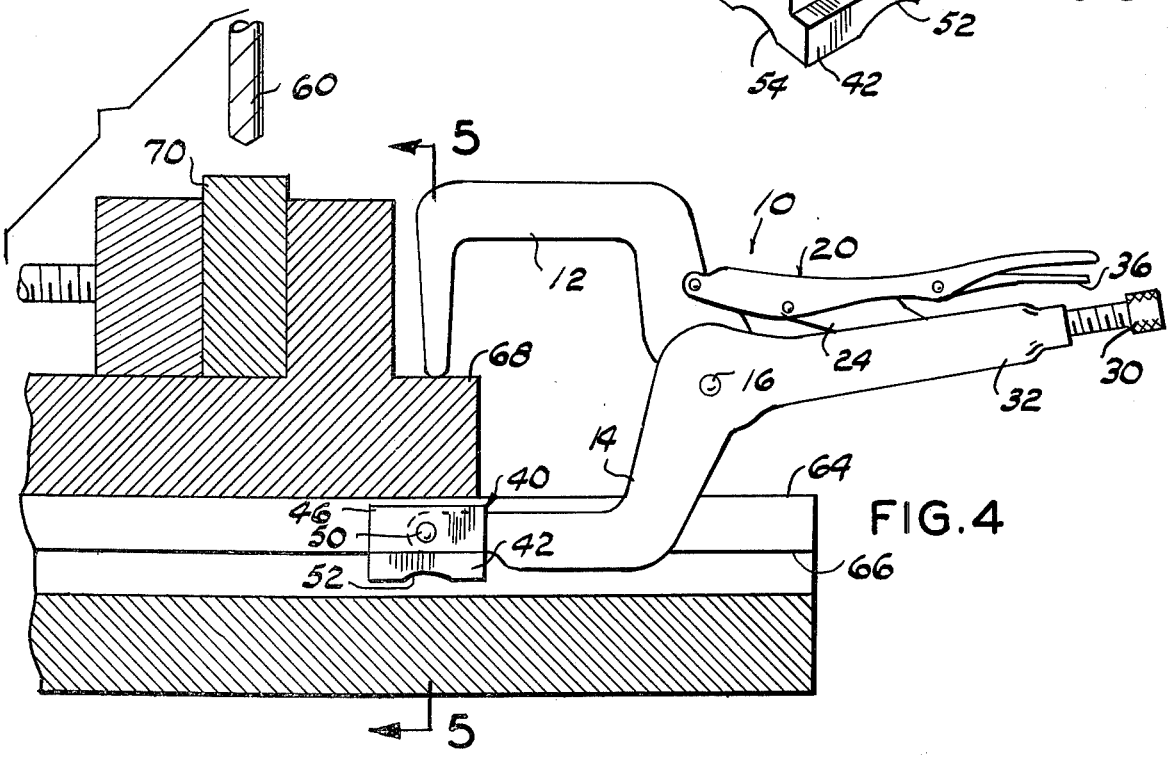
FIG. 4 is an elevational view, partially in section illustrating the clamp and adapter of FIG. 1 impinging a workpiece holding vise on the bed of a drill press, or the like; and, FIG. 5 is a vertical cross sectional view, partially in elevation, taken substantially along the line 5—5 of FIG. 4.

FIGS. 4 and 5 illustrate a milling machine or drill press platform bed 64 having at least one open end longitudinally extending inverted T-shaped slot 66 for connecting other equipment thereto in a well known manner.

The adapter 40 is simply inverted to a second position by rotating it about its hinge pin 50 to position the top surface of its T-shape to face away from the clamp jaw 12, in the position shown by FIG. 4, for cooperative slidable reception by the inverted T-shaped slot 66 which also slidably receives a portion of the clamp jaw 14. In this position a vise, or the like, 68 holding a workpiece 70, may be positioned in overlying relation with respect to the inverted T-shaped slot and adapter 40 therein so that when the clamp adjusting screw 30 is properly adjusted the clamp vise jaws may be closed to impinge the vise 68 against the bed 64 for performing work on the workpiece 70, as by drilling it with the drill bit 60.

Obviously the invention is susceptible to changes or alterations without defeating its practicability. Therefore, I do not wish to be confined to the preferred embodiment shown in the drawings and described herein.

I claim:

1. In a workpiece holding device in combination with a clamp having a substantially U-shaped jaw and an L-shaped jaw of flat form cooperatively disposed in a common plane, the U-shaped jaw having a bight portion and forward and rearward legs extending from the ends of the bight portion, and L-shaped jaw having a leg extending toward the rearward leg of the U-shaped jaw, a handle having one end rigidly fixed to the leg of the L-shaped jaw, a hinged connection between the end of the rear leg of the U-shaped jaw and the said end of said handle, an operating lever, a pivot coupling between one end of said operating lever and the rear leg of said U-shaped jaw at a location spaced outwardly from the hinged connection of said U-shaped jaw and the said end of the fixed handle, the free end of the forward leg of the U-shaped jaw and the free end of the L-shaped jaw opposite the handle being positioned to be brought into confronting contacting relation and a toggle arm coupling between the handle and the handle operating lever for locking the jaws against separation when the handle and the handle operating lever are forced toward each other, the improvement comprising:

pressure foot means including a table-like member having a top surface facing toward the forward leg of said U-shaped jaw when said table-like member is in a first position, said top surface having at least one transverse recess for engaging an irregular surface of a workpiece to be gripped by said table-like member and the forward leg of said U-shaped jaw and having at least one leg portion pivotally connected with the free end of the L-shaped clamp jaw on an axis normal to the plane of the jaws for cooperating with the free end of the forward leg of said U-shaped jaw and gripping a workpiece; and, a workpiece supporting horizontal platform having an open end elongated inverted T-shaped slot in which the pressure foot means is positionable in a second position with the top surface facing away from the forward leg of said U-shaped jaw, said pressure foot means being substantially T-shaped in transverse section for slidably entering the inverted T-shaped slot of the workpiece platform and connecting said L-shaped jaw with the workpiece platform for rigidly positioning a workpiece on the workpiece platform.

* * * * *